US005660314A

United States Patent [19]

Magnusson et al.

[11] Patent Number: 5,660,314

[45] Date of Patent: Aug. 26, 1997

[54] STAPLER

[75] Inventors: Lars-Inge Magnusson; Olle Strååt, both of Hestra; Trygve Gustafsson, Åsenhöga, all of Sweden

[73] Assignee: Isaberg AB, Hestra, Sweden

[21] Appl. No.: 549,703

[22] PCT Filed: May 20, 1994

[86] PCT No.: PCT/SE94/00470

§ 371 Date: Nov. 15, 1995

§ 102(e) Date: Nov. 15, 1995

[87] PCT Pub. No.: WO94/27788

PCT Pub. Date: Dec. 8, 1994

[30] Foreign Application Priority Data

Jun. 2, 1993 [SE] Sweden ..... 9301873

[51] Int. Cl.[6] ..... B25C 5/04; B27F 7/36

[52] U.S. Cl. ..... 227/2; 227/8; 227/87; 227/131; 227/155

[58] Field of Search ..... 227/2, 8, 82, 87, 227/98, 120, 131, 129, 136, 155

[56] References Cited

U.S. PATENT DOCUMENTS

| | | | |
|---|---|---|---|
| 4,623,082 | 11/1986 | Kurosawa | 227/131 |
| 4,726,505 | 2/1988 | Okazaki | 227/131 |
| 5,195,671 | 3/1993 | Shimomura et al. | 227/120 |
| 5,230,457 | 7/1993 | Hiroi et al. | 227/131 |
| 5,460,313 | 10/1995 | Magnusson et al. | 227/8 |

FOREIGN PATENT DOCUMENTS 469 113 5/1993 Sweden .

*Primary Examiner*—Scott A. Smith
*Attorney, Agent, or Firm*—Shapiro and Shapiro

[57] ABSTRACT

A stapler comprises a stapler head which accommodates a strip of wire staple blanks and is pivotable between a starting position and a working position, in which it is applied against a sheaf of papers. A staple shaper shapes the blanks into substantially U-shaped staples, and a staple driver releases the thus-formed staples from the strip and drives them one by one into the sheaf of papers. A pivotable operating device reciprocates the staple shaper and the staple driver. A drive device is adapted to pivot the operating device in such a manner that it causes the staple driver to drive a staple into the sheaf of papers in a driving stroke and causes the staple shaper to shape the following staple in a shaping stroke, as well as adapted to pivot the stapler head to its working position before the staple driver performs the driving stroke and retain it there during the driving stroke of the staple driver. The drive device synchronizes the pivotal movements of the stapler head and the operating device in such a manner that the staple driver performs a prolonged stroke in the driving direction and the staple shaper performs the last phase of the shaping stroke when the stapler head has left its working position in order to be pivoted back to its starting position.

1 Claim, 6 Drawing Sheets

STAPLER

BACKGROUND OF THE INVENTION

This invention relates to a stapler for driving staples into an object, such as a sheaf of papers, said stapler comprising a base, a stapler head pivotably connected to the base via a first pin and pivotable between a starting position and a working position, in which it is applied against said object when this is placed in the stapler between the stapler head and the base, the stapler head being adapted to accommodate wire staple blanks which are juxtaposed and releasably interconnected to form at least one strip of staple blanks, a reciprocating staple shaper arranged in the stapler head to successively shape the staple blanks of the strip into substantially U-shaped staples, a reciprocating staple driver arranged in the stapler head to successively release the thus-formed staples from the strip and drive them into said object, an operating means which is pivotable about a second pin parallel to the first pin and which is adapted to reciprocate the staple shaper and the staple driver, and a drive means adapted to pivot the stapler head and the operating means in synchronism such that the operating means causes the staple driver, in a driving stroke, to drive a staple into said object and causes the staple shaper, in a shaping stroke, to shape the following staple, and such that the stapler head is pivoted to its working position before the staple driver performs the driving stroke, and is retained there during the driving stroke of the staple driver.

A prior-art stapler of this type is described in SE Patent Application 9201231-9. In this known stapler, the operating means is made up of two pivotable arms, which engage the staple shaper and the staple driver so as to reciprocate these during their pivotal movement. When the arms are being pivoted in the one direction, the staple shaper bends a staple blank into a U-shaped staple and the staple driver releases the U-shaped staple formed by the staple shaper during the preceding stapling cycle and drives it into the object at issue. While this is done, the stapler head is retained in its working position and is thus applied against the object.

In this known stapler, it is essential that the staple shaper completes the shaping stroke just as the staple driver completes the driving stroke, i.e., that the staple shaper and the staple driver reach their turning positions at exactly the same time. Should the staple shaper, as a result of dimensional imperfections, complete the shaping stroke before the staple driver has completed the driving stroke, the staple will not be driven into the object in its entirety, which of course is unacceptable. Should the staple driver complete the driving stroke, thus putting an end to the pivotal movement of the arms in said one direction, before the staple shaper has completed the shaping stroke, the resulting staple will be imperfectly shaped and will probably block up the stapler. Such premature ending of the driving stroke of the staple driver may, apart from dimensional imperfections, be due to a staple coming askew when it is be driven into the object, so that the staple is not driven into the object in its entirety but is deformed above it, thereby preventing completion of the driving stroke and, hence of the shaping stroke.

SUMMARY OF THE INVENTION

An object of the invention is to remedy this drawback and provide a stapler ensuring that the blank is shaped into a completed staple, regardless of whether the driving-stroke of the staple driver ends "too soon" or not.

According to the invention, this object is achieved by a stapler which is of the type mentioned by way of introduction and which is characterised in that the drive means is adapted to synchronise the pivotal movements of the stapler head and the operating means in such a manner that the staple driver performs a prolonged stroke in the driving direction and the staple shaper performs the last phase of the shaping stroke when the stapler head has left its working position in order to be pivoted back to its starting position.

BRIEF DESCRIPTION OF THE DRAWINGS

The invention will be described in more detail below with reference to the accompanying drawings, in which.

DESCRIPTION OF THE PREFERRED EMBODIMENT

Figure 2:
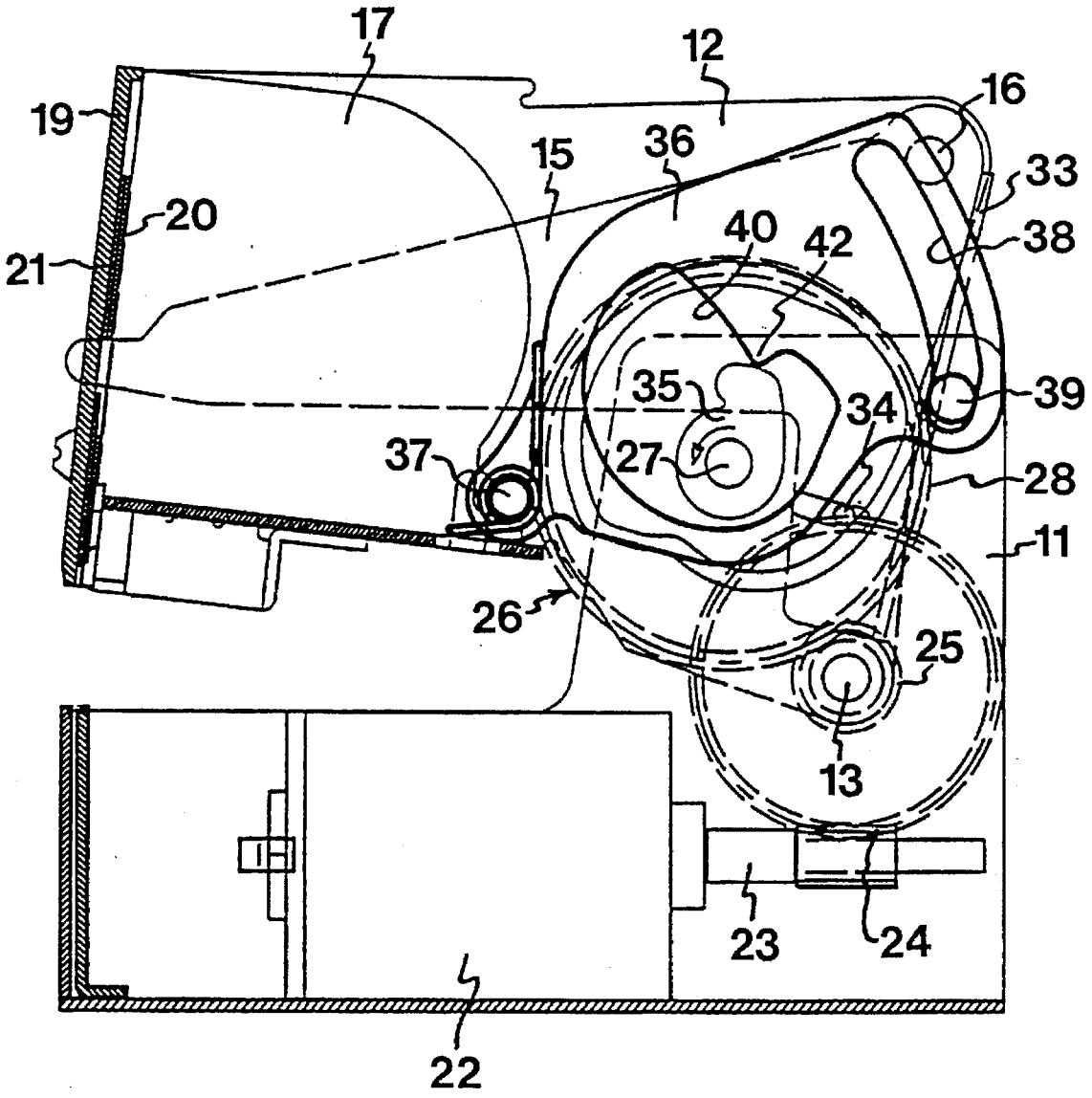
FIGS. 2–5 are longitudinal sections showing the stapler in different stapling positions.

The illustrated stapler is electrically operated and comprises a fixed base 11 and a stapler head 12 pivotably connected to the base 11. The stapler head 12 is pivotable about a transverse pin 13 between an upper starting position (shown in FIG. 2) and a lower working position (shown in FIGS. 3 and 4), in which it is applied against a sheaf of papers 14 placed in the stapler between the base 11 and the stapler head 12. Thus, the working position of the stapler head 12 depends on the thickness of the sheaf of papers 14.

Figure 1:
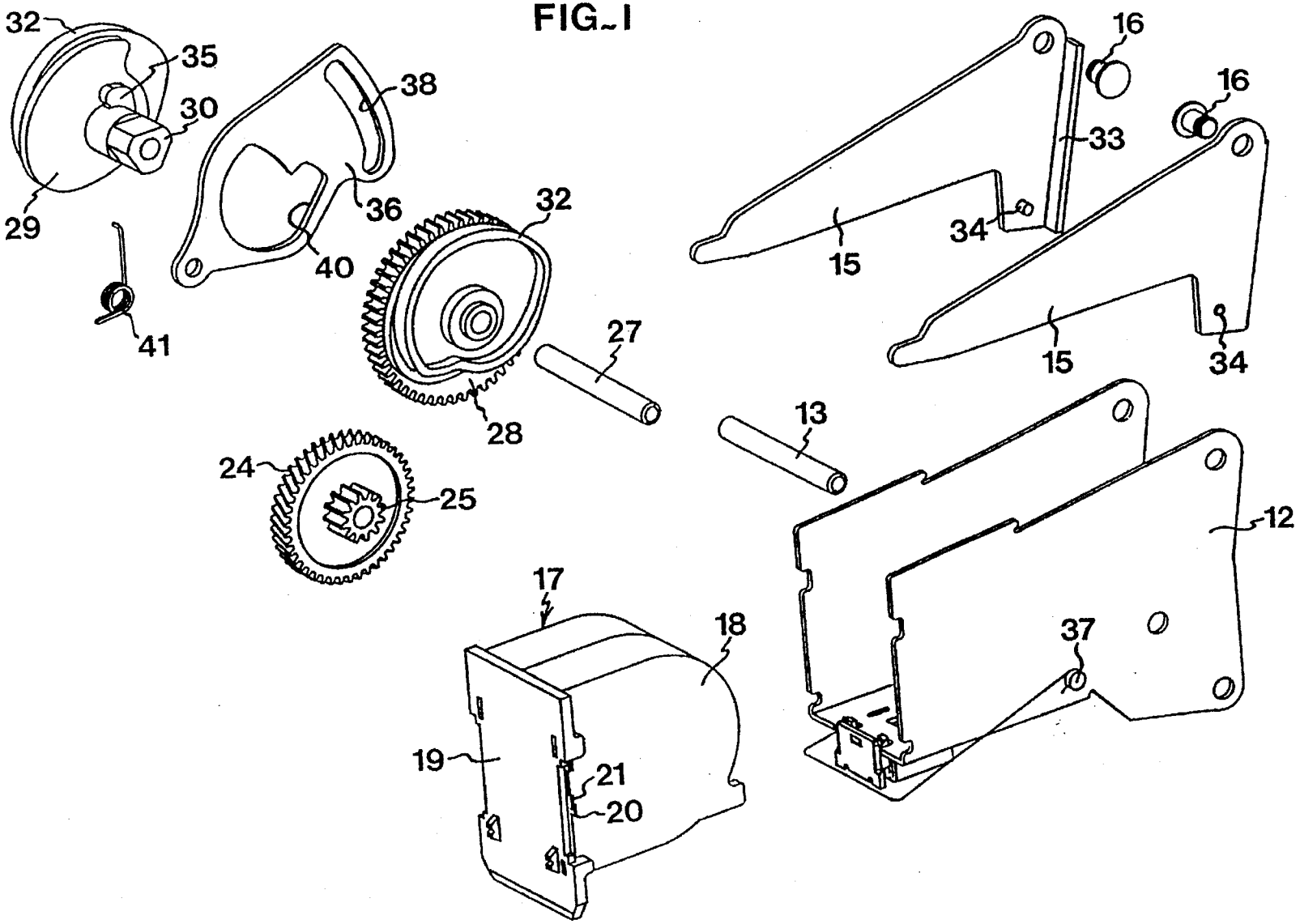
FIG. 1 is an exploded view showing parts of an inventive stapler in perspective.
Figure 4:
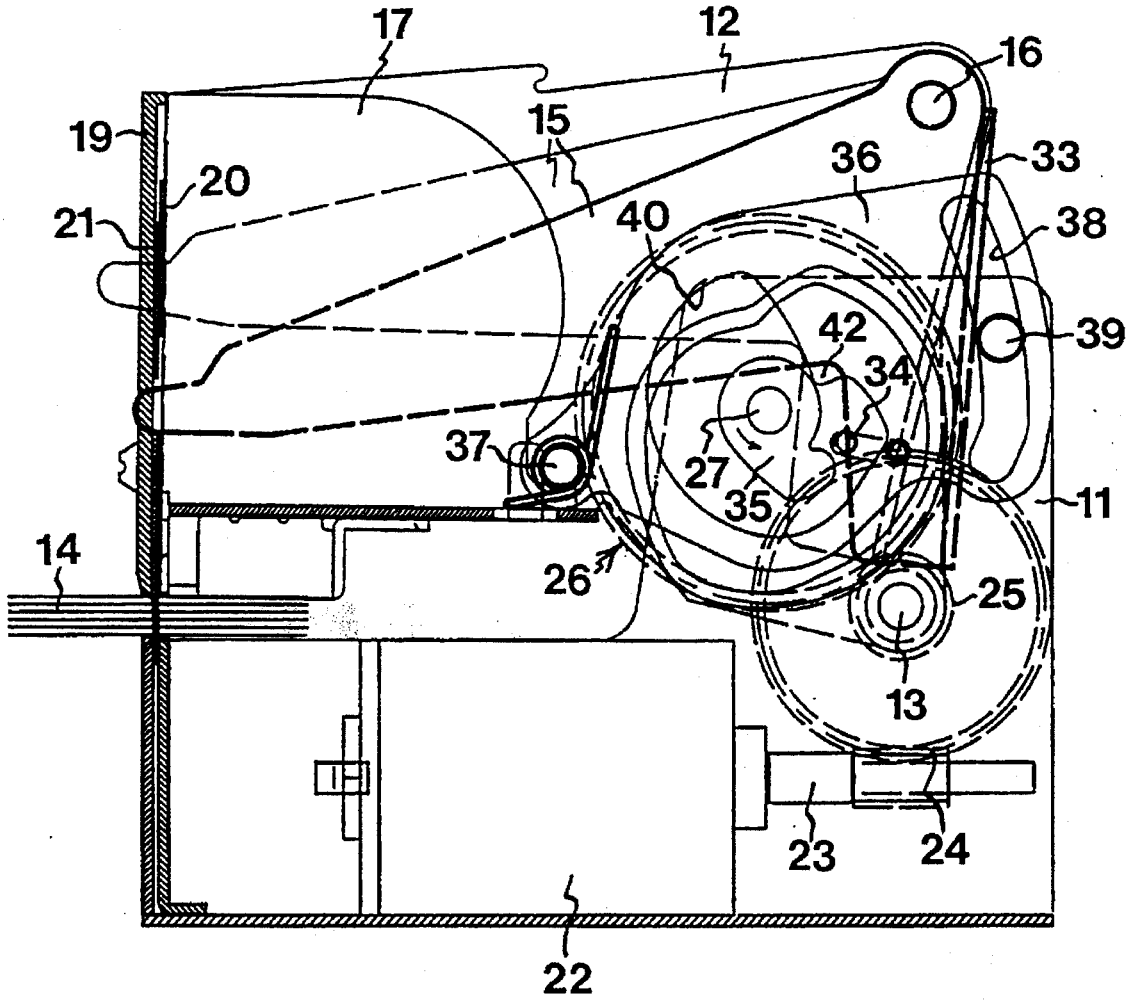
Figure 5:
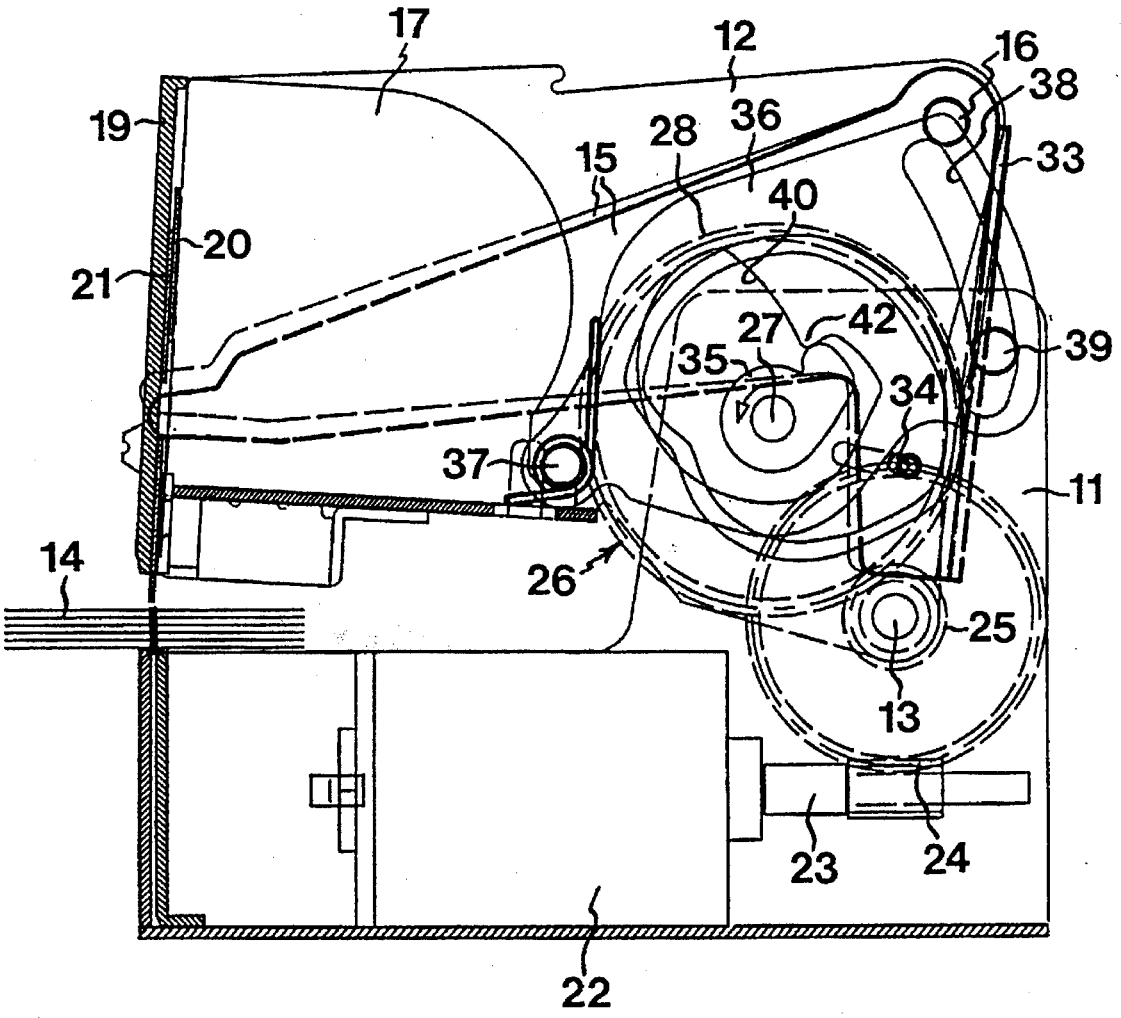
Figure 6:
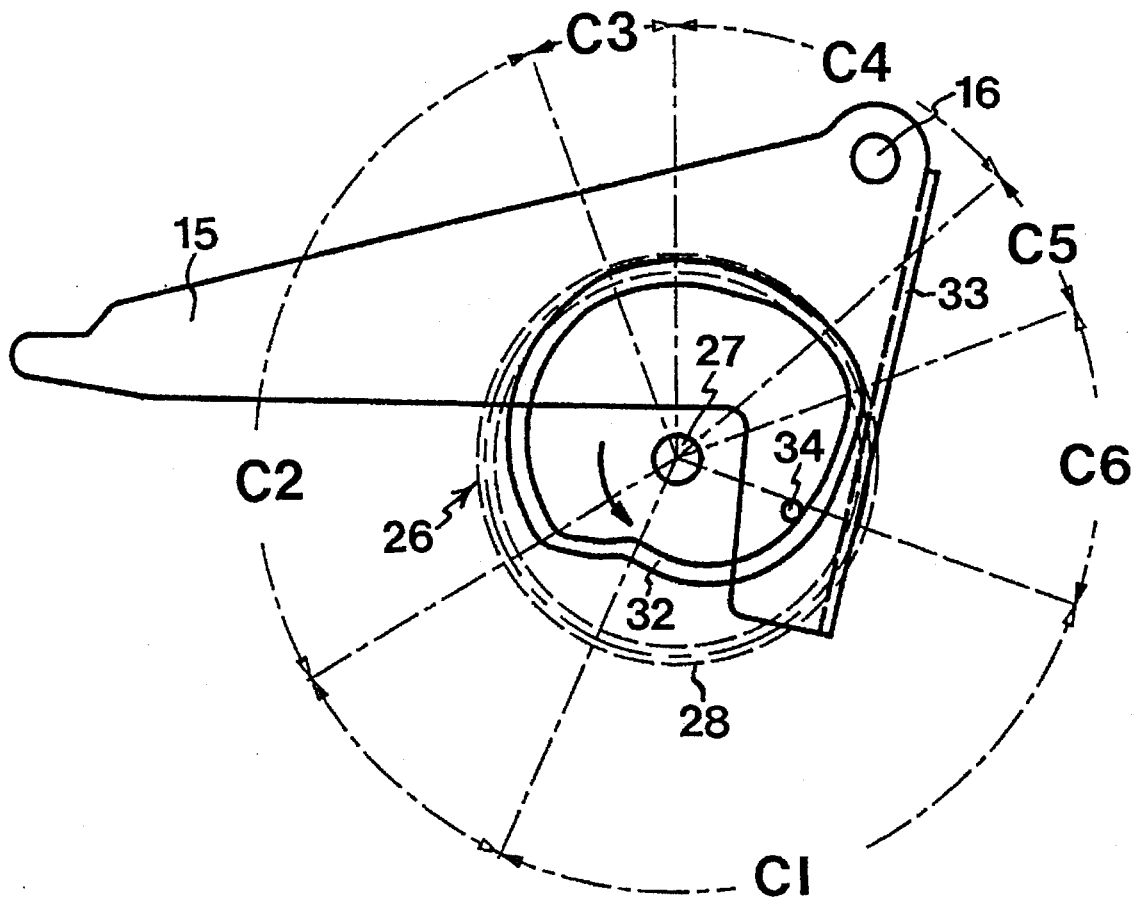
FIG. 6 is a view showing parts of a cam mechanism.

The stapler head 12 is a U-shaped channel (see FIG. 1) in which there is provided a drive mechanism in the form of two arms 15. At the rear ends, the arms 15 are each pivotably connected to a side wall of the U-shaped channel. The arms 15 extend forwards in parallel with the side walls and project, at the front ends, a certain distance beyond the stapler head 12. The arms 15 are each pivotable about a transverse pivot pin 16 fixed to a channel side wall. The pivot pins 16 are located opposite to one another and are parallel to the pin 13. The arms 15 are pivotable in relation to the stapler head 12 between an upper turning position (indicated by thin lines in FIG. 4) and a lower turning position (indicated by thick lines in FIG. 5).

A magazine 17 containing staple blanks (not shown) is mounted in the front portion of the stapler head 12. In this case, the magazine is a cassette of the type described in SE Patent Application 9201230-1. The cassette 17 has a casing 18 containing straight wire blanks which are juxtaposed and releasably interconnected to form a strip of staple blanks, which is rolled up into a roll (not shown). The cassette 17 also has a front plate 19, in which a staple shaper 20 and a staple driver 21 are arranged in reciprocating fashion. At the front portions, the arms 15 engage the staple shaper 20 and the staple driver 21 so as to reciprocate these upwards and downwards during their pivotal movements when the arms 15 are being swung downwards, the staple shaper 20 and the staple driver 21 are moved downwards, and the staple shaper 20 bends a staple blank into a U-shaped staple while the staple driver 21 releases the U-shaped staple formed by the staple shaper 20 during the preceding stapling. Cycle and drives it into the sheaf of papers 14. Naturally, this takes place when the stapler head 12 is in its working position, i.e., applied against the sheaf of papers 14.

As mentioned in the foregoing, the stapler is electrically operated, and is driven by an electric motor provided in the base 11. Via a worm gear 24, the output shaft 23 of the motor 22 drives a driving gear wheel 25. The wheel 25 is rotatably mounted on the pin 13 which is connected to the base 11 and about which the stapler head 12 pivots. The driving gear wheel 25 is adapted to drive a cam mechanism 26 provided in the stapler head 12 and rotatably mounted on a pin 27 which is parallel to the pin 13 and connected to the stapler head. To this end, the driving gear wheel 25 meshes with a gear wheel 28 forming part of the cam mechanism 26 and mounted on the pin 27. In addition to the gear wheel 28, the cam mechanism 26 includes a cam wheel 29 which is non-rotatably connected to the gear wheel 28. The gear wheel 28 and the cam wheel 29 are interconnected by a hub portion 30 which is provided on the cam wheel 29 and has a non-circular cross-section and which is inserted in a centre hole provided in the gear wheel 28 and having a corresponding cross-sectional shape.

The gear wheel 28 and the cam wheel 29 each have a closed cam curve 32 with a cam surface facing radially outwards and a cam surface facing radially inwards. The cam curves 32 are identical and cooperate with the respective arms 15 so as to pivot, when the cam mechanism 26 rotates, the arms 15 in synchronised fashion between the upper turning positions and the lower turning positions. The outward cam surface then cooperates with a rear flange 33 on the respective arms 15, while the inward cam surface cooperates with a pin 34 connected to the respective arms 15 and located slightly ahead of the flange 33.

The hub portion 30 has a cam means 35, non-rotatably connected thereto, of pear-like cross-sectional shape. The cam means 35 has a first portion which extends throughout most of its circumference and has a constant radius with respect to the pin 27, as well as a second portion which extends throughout a much smaller part of its circumference and also has a constant radius. As appears from FIGS. 2–5, the radius of the second portion is much larger than that of the first portion.

A locking plate 36 parallel to the side walls of the stapler head 12 is pivotably connected to the stapler head 12. The locking plate 36 is pivotable about a pin 37 parallel to the pins 13 and 27 and fixed in the lower portion of the stapler head 12 at a considerable distance ahead of the pivot pin 13 of the stapler head 12. Also, the locking plate 36 has an arcuate slot 38 in which engages a locking pin 39 parallel to the pins 13, 27 and 37. The locking pin 39 is fixedly connected to the base 11 at the upper rear portion thereof (behind and above the pin 13). At the centre, the locking plate 36 has a hole 40 of a special shape. The hub portion 30 of the cam mechanism 26 extends through the hole 40, and the cam means 35 on the hub portion 30 is located axially opposite to the locking plate 36 so as to cooperate with the boundary wall of the hole 40, as shown in FIGS. 2–5.

The locking plate 36 is pivotable between an upper first position (shown in FIG. 2) in which the locking pin 39 is located in a lower end portion of the arcuate slot 38, and a lower second position (shown in FIGS. 3 and 4) which depends on the thickness of the sheaf of papers 14 and in which the locking pin 39 is located in an intermediary portion of the arcuate slot. 38. The locking plate 36 is biased towards the second position by a spring 41 mounted on the pin 37 between the bottom of the stapler head 12 and the front edge of the locking plate 36. With respect to the pin 37, the arcuate slot 38 has a radius of curvature increasing in the direction away from the lower end portion towards the upper end portion. First, the radius of curvature increases considerably throughout a small part of the length of the slot 38, and then increases slowly throughout the remainder of the slot length. The reason for this will be explained in more detail below.

The function of the stapler will now be described in more detail with reference to FIGS. 2–6.

In the starting position (FIG. 2), the stapler head 12 is in its upper position and the cam mechanism 26 occupies such a rotational position that the cam curves 32 maintain the arms 15 in an intermediary position between the two turning positions and that the large-radius second portion of the cam means 35 is applied against a projection 42 on the boundary wall surrounding the hole 40 in the locking plate 36 and maintains the locking plate 36 in its upper first position, so that the spring 41 is unable to urge the locking plate 36 to its lower second position.

Figure 3:
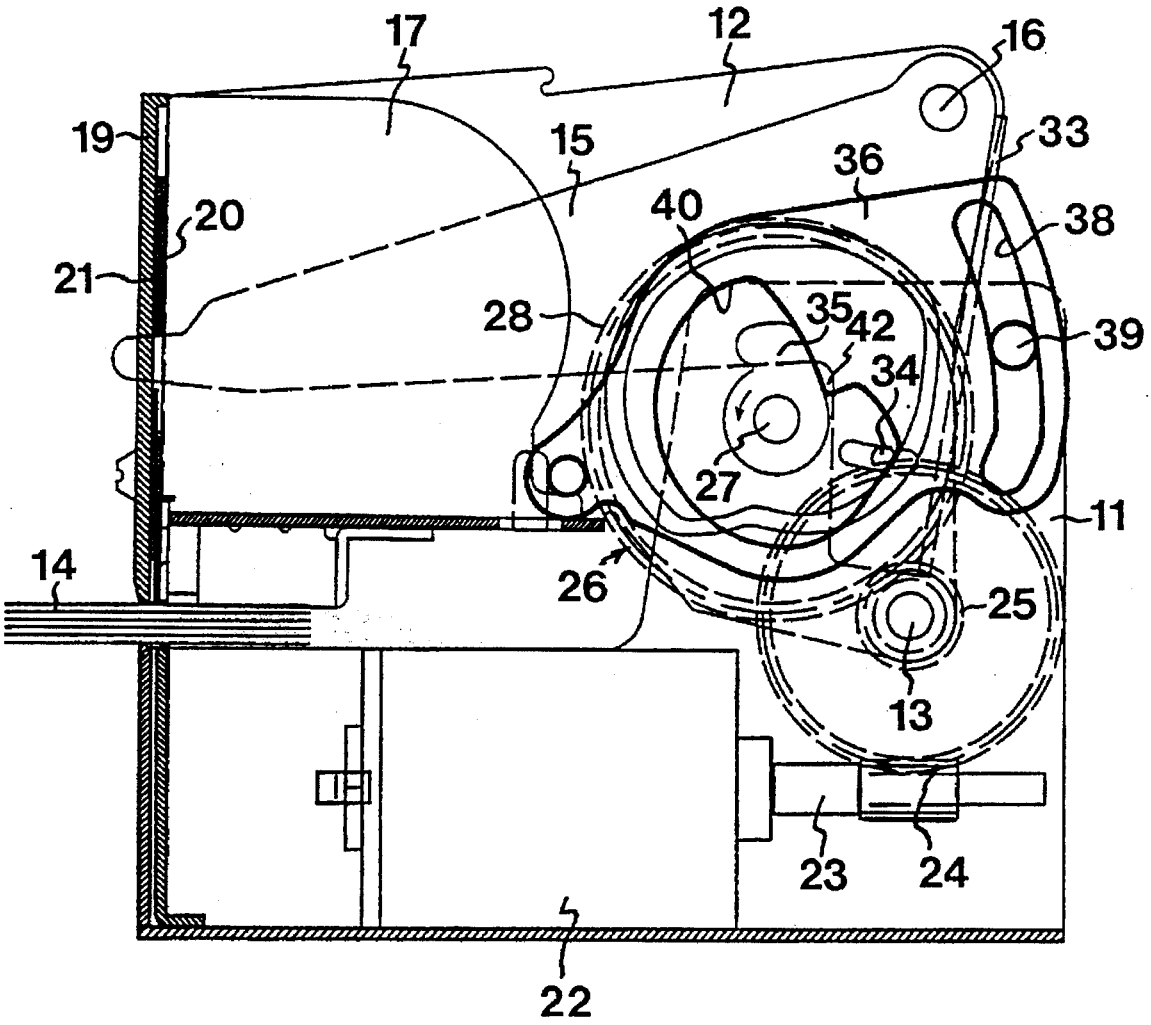

When a sheaf of papers 14 is placed in the stapler, a microswitch (not shown) is actuated and starts the motor 22. Then, the motor 22 rotates the gear wheel 28, which meshes with the driving gear wheel 25, and consequently the entire cam mechanism 26, one turn anticlockwise with respect to FIGS. 2–6 when the cam mechanism 26, and hence the cam means 35, has been turned slightly, the cam means releases the locking plate 36, which then is moved to its lower second position (FIG. 3) by the spring 41. Since the arcuate slot 38 has a radius of curvature increasing in the direction away from the lower end portion towards the upper end portion with respect to the pin 37, the distance between the locking pin 39 and the pin 37 has to increase while the locking plate 36 is swung downwards. This increase in distance is achieved by the pin 37, connected to the stapler head 12, pivoting the stapler head 12 downwards to its working position (FIG. 3). Since the locking pin 39, during the pivotal movement of the locking plate 36 from the upper first position to the lower second position, first passes the short slot portion where the increase in radius of curvature is considerable, the stapler head 12 is initially swung downwards quite rapidly. This rapid downward movement takes place in an area where the stapler head 12 does not run the risk of hitting a sheaf of papers i.e., in an area located above the thickest sheaf that can be placed in the stapler.

The stapler head 12 is locked in its working position since it cannot be swung upwards about the pivot pin 13 because the increase of the radius of curvature of the arcuate slot 38 is so chosen with respect to the material (preferably hardened steel) of which the locking plate and the locking pin 39 are made, that a locking wedge action occurs between the wall of the slot 38 and the locking pin 39.

During the initial rotation of the cam mechanism the cam curves 32 are applied against the pins 34 of the respective arms 15 by a circumferential portion C1 of the cam surface that faces radially inwards. The circumferential portion C1 has a decreasing radius with respect to the pin 27 in order to swing the arms 15 to their upper turning positions in cooperation with the respective pins 34. The circumferential portion C1 has an extent of about 95°. When the stapler head 12 reaches the sheaf of papers 14 (FIG. 3), the arms 15 are thus being swung upwards.

When the cam mechanism 26 is further rotated, the cam curves 32 come to be applied against the flanges 33 of the respective arms 15 by a circumferential portion C2 of the cam surface that faces radially outwards. The circumferential portion C2 has a slightly increasing radius with respect to the pin 27 and an extent of about 100°. When the cam mechanism 26 is further rotated, the arms 15 are thus swung downwards to a lower position (indicated by thick lines in FIG. 4) in which they have moved the staple shaper 20 and the staple driver 21 to lower positions, which means that the staple driver 21 is located quite near the uppermost sheet of paper of the sheaf 14 after having driven a staple into it and that the staple shaper 20 has begun bending of the following staple blank.

When the cam mechanism 26 is further rotated, the cam curves 32 come to be applied against the flanges 33 of the respective arms 15 by a circumferential portion C3 of the cam surface that faces radially outwards. The circumferential portion C3 has a constant radius in order to retain the arms 15, and hence the staple shaper 20 and the staple driver 21, in their lower positions during a clinching operation (not described in detail here) for bending the legs of the inserted staple against the underside of the sheaf of papers 14. The circumferential portion C3 has an extent of about 20° and merges into a circumferential portion C4 of the cam surface that faces radially outwards. Also the circumferential portion C4 has a constant radius so as to retain the arms 15, and hence the staple shaper 20 and the staple driver 21, in their lower positions. The circumferential portion C4 has an extent of about 50°.

In the phase when the arms 15 are retained in their lower positions by the circumferential portion C4, the large-radius second portion of the cam means 35 hits the projection 42 and pivots the locking plate 36 back to its upper first position against the action of the spring 41. The stapler head 12 is thus swung to its upper position as a result of the decrease of the radius of curvature of the arcuate slot 38 in the direction away from its upper end portion towards its lower end portion.

While the stapler head 12 is thus swung back to its upper position, the cam curves 32 come to be applied against the flanges 33 of the respective arms 15 by a circumferential portion C5 of the cam surface that faces radially outwards. The circumferential portion C5 has a slightly increasing radius with respect to the pin 27 so as to pivot the arms 15 to their lower turning positions (indicated by thick lines in FIG. 5). The circumferential portion C5 has an extent-of about 20°. When the arms 15 occupy their lower turning positions, the staple shaper 20 has completed bending of the staple blank and the staple driver 21 occupies a position in which it projects from the stapler head 12. When the staple driver 21 performs this prolonged stroke in the driving direction, i.e., moves from the lower position shown in FIG. 4 to the lower turning position shown in FIG. 5, it can expel a staple that for some reason has not been driven into the sheaf of papers during the driving stroke, but has been deformed and got stuck in the stapler head 12.

In the final phase of the revolution of the cam mechanism 26, the cam curves 32 come to be applied against the pins 34 of the respective arms 15 by a circumferential portion C6 of the cam surface that faces radially inwards. The circumferential portion C6 has a decreasing radius with respect to the pin 27 so as to pivot the arms 15 towards their upper turning positions (indicated by thin lines in FIG. 4). The circumferential portion C6 has an extent of about 40° and merges into the circumferential portion C1, which pivots the arms 15 further upwards, as described above. The transition between the circumferential portion C6 and the circumferential portion C1 corresponds to the starting position illustrated in FIG. 2.

We claim:

1. A stapler for driving staples into an object, said stapler comprising a base, a stapler head pivotably connected to the base via a first pin and pivotable between a starting position and a working position, in which said stapler head is applied against said object when said object is placed in the stapler between the stapler head and the base, the stapler head being constructed to accommodate wire staple blanks which are juxtaposed and releasably interconnected to form at least one strip of staple blanks, a reciprocating staple shaper arranged in the stapler head to successively shape the staple blanks of the at least one strip into substantially U-shaped staples, a reciprocating staple driver arranged in the stapler head to successively release the substantially U-shaped staples from the at least one strip and drive the substantially U-shaped staples into said object, operating means which is pivotable about a second pin parallel to the first pin and which reciprocates the staple shaper and the staple driver, and drive means that pivots the stapler head and the operating means in synchronism such that the operating means causes the staple driver, in a driving stroke, to drive a substantially U-shaped staple into said object and causes the staple shaper, in a shaping stroke, to shape a following staple blank into a substantially U-shaped staple, and such that the stapler head is pivoted to said working position before the staple driver performs the driving stroke, and is retained in said working position during the driving stroke of the staple driver, wherein the drive means synchronizes the pivotal movements of the stapler head and the operating means such that the staple driver continues the driving stroke and the staple shaper performs a last phase of the shaping stroke when the stapler head has left said working position in order to be pivoted back to said starting position.

* * * * *